US007969268B2

(12) United States Patent
Dal Re et al.

(10) Patent No.: US 7,969,268 B2
(45) Date of Patent: Jun. 28, 2011

(54) IGNITION COIL WITH SPACED SECONDARY SECTOR WINDINGS

(75) Inventors: Massimo Dal Re, Modena (IT); Giuseppe Fulchini, Carpi (IT)

(73) Assignee: Federal Mogul Ignition Company, Southfield, MI (US)

( * ) Notice: Subject to any disclaimer, the term of this patent is extended or adjusted under 35 U.S.C. 154(b) by 0 days.

(21) Appl. No.: 12/541,425

(22) Filed: Aug. 14, 2009

(65) Prior Publication Data

US 2010/0039198 A1 Feb. 18, 2010

Related U.S. Application Data

(60) Provisional application No. 61/089,070, filed on Aug. 15, 2008.

(51) Int. Cl.
*H01F 27/02* (2006.01)
*H01F 38/12* (2006.01)
*F02P 3/02* (2006.01)

(52) U.S. Cl. ..... 336/92; 336/90; 123/634; 123/635

(58) Field of Classification Search ..... 336/90, 336/92; 123/634, 635
See application file for complete search history.

(56) References Cited

U.S. PATENT DOCUMENTS

| | | | | |
|---|---|---|---|---|
| 6,483,410 | B2 | 11/2002 | Bernardi et al. | |
| 6,501,360 | B2 | 12/2002 | Martagni et al. | |
| 6,636,138 | B2 | 10/2003 | Bernardi et al. | |
| 6,964,263 | B2 * | 11/2005 | Xi et al. | 123/499 |
| 7,053,746 | B2 | 5/2006 | Widiger et al. | |
| 7,382,220 | B2 | 6/2008 | Keller | |
| 2002/0046746 | A1 | 4/2002 | Nakabayashi et al. | |
| 2003/0183215 | A1 | 10/2003 | Miwa et al. | |
| 2004/0075517 | A1 * | 4/2004 | Betz et al. | 336/90 |
| 2004/0231652 | A1 * | 11/2004 | Kondo et al. | 123/634 |

FOREIGN PATENT DOCUMENTS

EP 0893599 7/1997

* cited by examiner

*Primary Examiner* — Anh T. Mai
*Assistant Examiner* — Ronald W Hinson
(74) *Attorney, Agent, or Firm* — Robert L. Stearns; Dickinson Wright, PLLC

(57) ABSTRACT

An ignition coil configured for electrical communication with a spark plug of an internal combustion engine has a primary spool and a secondary spool. The primary spool has a bore and an outer surface with a low-voltage winding supported thereon. The secondary spool has a cavity with a magnetic core received therein and a substantially cylindrical outer surface. The secondary spool is received at least partially in the bore of the primary spool. A high-voltage winding is supported on the outer surface of the secondary spool. The high-voltage winding has discrete winding sectors spaced from one another along a length of the secondary spool.

15 Claims, 1 Drawing Sheet

IGNITION COIL WITH SPACED SECONDARY SECTOR WINDINGS

CROSS-REFERENCE TO RELATED APPLICATION

This application claims the benefit of U.S. Provisional Application Ser. No. 61/089,070, filed Aug. 15, 2008, which is incorporated herein by reference in its entirety.

BACKGROUND OF THE INVENTION

1. Technical Field

This invention relates generally to an ignition system for an internal combustion engine, and more particularly to an ignition coil for an ignition system.

2. Related Art

Ignition coils commonly have an outer shell that houses a central magnetic core with secondary or high voltage windings and primary or low voltage windings disposed between the magnetic core and the shell. Typically, the secondary high voltage windings are wound over a continuous cylindrical path on an outer surface of a secondary spool, with the magnetic core being received in the secondary spool, and the primary low voltage windings are wound on an outer surface of a primary spool, wherein the secondary spool is received concentrically within the primary spool. Unfortunately, parasitic capacitance in these electrical windings unavoidable and undesirable. The parasitic capacitance exists between the individual windings simply because of their proximity to each other. The individual windings, particularly with regard to the high voltage secondary windings given their increased number in relation to the primary low voltage windings, often acts as parallel capacitors, due to their closely spaced, abutting relation to one another. As a result, any change in the voltage across the coil requires extra current to charge these intrinsic capacitors. Accordingly, the efficiency, and thus, the performance of the ignition coil for a given current is reduced.

SUMMARY OF THE INVENTION

An ignition coil configured for electrical communication with a spark plug of an internal combustion engine has a primary spool with a bore and an outer surface and a low-voltage winding supported on the outer surface of the primary spool. A secondary spool having a cavity and a substantially cylindrical outer surface extending along a longitudinal axis is received at least partially in the bore of the primary spool. A magnetic core is received in the cavity of the secondary spool. A high-voltage winding is supported on the cylindrical outer surface of the secondary spool. The high-voltage winding has discrete winding sectors spaced from one another along the longitudinal axis.

In accordance with another aspect of the invention, at least some of the discrete winding sectors are trapezoidal in shape.

In accordance with another aspect of the invention, at least some of the discrete winding sectors have different lengths extending along a longitudinal axis of the ignition coil from one another.

In accordance with another aspect of the invention, at least some of the discrete winding sectors have different outer diameters from one another.

In accordance with yet another aspect of the invention, the discrete winding sectors can be varied in number.

In accordance with yet another aspect of the invention, the induction in a central region of the ignition coil is maximized.

BRIEF DESCRIPTION OF THE DRAWINGS

These and other aspects, features and advantages of an ignition coil constructed in accordance with the invention will become more readily appreciated when considered in connection with the following detailed description of presently preferred embodiments and best mode, appended claims and accompanying drawings, in which:

DETAILED DESCRIPTION OF PRESENTLY PREFERRED EMBODIMENTS

Figure 1:
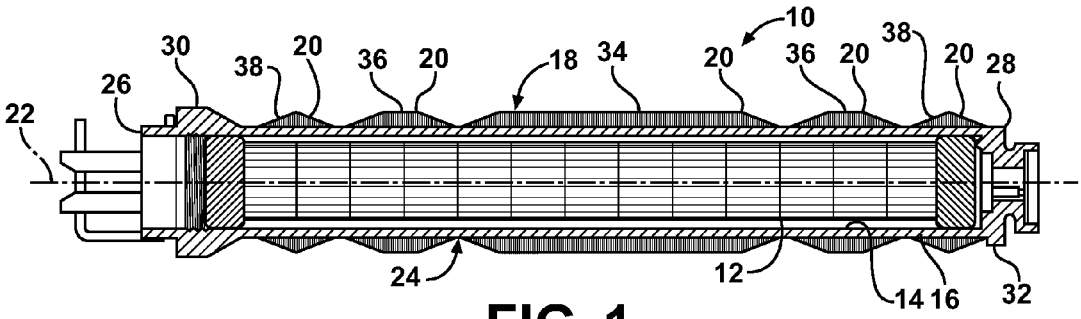
FIG. 1 is a cross-sectional view taken along a longitudinal axis of an ignition coil constructed according to one presently preferred embodiment of the invention.

Referring in more detail to the drawings, FIG. 1 illustrates an ignition coil secondary coil portion 10 constructed in accordance with one aspect of the invention. The secondary coil portion 10 has a magnetic core 12 extending along a rectilinear axis which includes a stack of metal laminations made of a material with high magnetic permeability. The laminated magnetic core 12 is housed inside a cylindrical cavity 14 of a secondary spool 16 made of plastic material, on which a high-voltage winding 18 is wound. The secondary spool 16 is in turn inserted inside a primary spool (not shown in FIG. 1) made of plastic material on which a low-voltage winding (also not shown) is wound. The secondary coil portion 10, along with the primary spool and low-voltage winding, are inserted in an outer tubular casing (not shown), as is known. After assembly of the various components, the casing can be filled with a dielectric resin, for example of the epoxy type, which forms an insulator between the various components of the ignition coil. The high-voltage winding 18 is wound on the secondary spool 16 to form individual winding sectors 20 spaced from one another along a longitudinal axis 22 of the ignition coil. As such, with the sectors 20 being spaced from one another, the parasitic capacitance is minimized, and thus, the efficiency and performance of the ignition coil is enhanced.

The secondary spool 16 is constructed having a cylindrical or substantially cylindrical outer surface 24 extending between opposite ends 26, 28. Adjacent the ends 26, 28, the secondary spool 16 can be formed with radially outwardly extending flanges or members 30, 32, if desired.

The high-voltage winding 18 is wound on the outer surface 24 of the secondary spool 16 in a configuration that minimizes the potential for parasitic capacitance. The individual sectors 20 have a length and diameter provided by a predetermined number of windings and an overall length and diameter of the secondary spool 16. As such, the length and diameter of the individual sectors 20 can be tightly controlled and varied relative to one another, as desired. In addition, the number of sectors 20 can be varied from one application to another, as desired. For example, as shown in FIG. 1, the secondary coil portion 10 has 5 individual winding sectors 20, with a central sector 34, two intermediate sectors 36 adjacent opposite ends of the central sector 34 and two end sectors 38 adjacent the intermediate sectors 36 and adjacent the opposite ends 26, 28 of the secondary spool 16. The central and intermediate sectors 34, 36 are generally trapezoidal in shape, with the central sector 34 having an increased length relative to the intermediate sectors 36 and the end sectors 38. With the central sector 34 having the greatest length of all the sectors, the induction in the central region is maximized by locating the greatest length central sector 34 over the portion of the magnetic core 12 having the largest values of induction. The end sectors 38 are generally triangular in shape and are preferably the shortest of the sectors. Although some of the sectors have different shapes, each of the sectors 20 is formed having the same or substantially the same outer diameter, which is controlled during the winding process.

Figure 2:
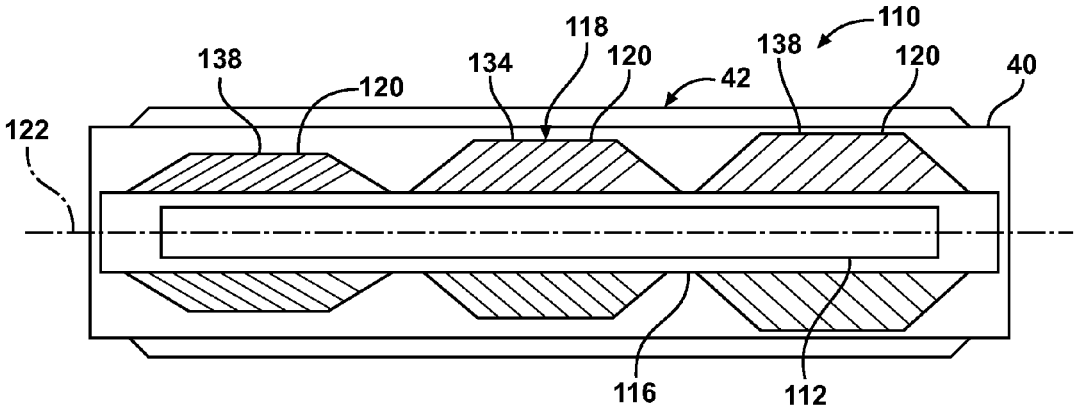
FIG. 2 is a schematic partial cross-sectional view taken along a longitudinal axis of an ignition coil constructed according to another presently preferred embodiment of the invention.

In FIG. 2, a schematic view of another secondary coil portion 110 is shown, wherein the same reference numerals offset by a factor of 100 are used to identify similar features as discussed above. The secondary coil portion 110 has a magnetic core 112, a secondary spool 116 with a high-voltage winding 118 thereon, a primary coil 40 with a low-voltage winding 42 thereon. The high-voltage winding 118 is wound to form three individual sectors 120 spaced axially from one another along a longitudinal axis 122 of the assembly. As such, a central sector 134 is flanked at its ends by two adjacent end sectors 138. Each of the sectors 134, 138 is represented as having the same or substantially the same length, however, each has a different outer diameter, with one end sector 138 having the smallest outer diameter, the other end sector 138 having the largest outer diameter and the central sector 134 having an intermediate outer diameter. Accordingly, the sectors increase progressively in diameter from one end of the secondary coil to the other end of the secondary coil. As such, each sector 134, 138 has a different number of windings, with the largest diameter sector having the greatest number of windings and smallest diameter sector having the fewest number of windings.

Figure 3:
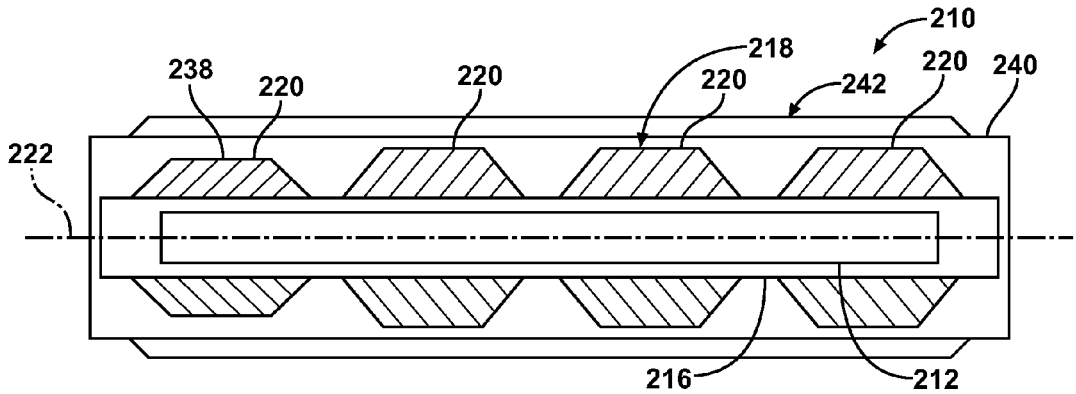
FIG. 3 is a schematic partial cross-sectional view taken along a longitudinal axis of an ignition coil constructed according to another presently preferred embodiment of the invention.

In FIG. 3, a schematic view of another secondary coil portion 210 is shown, wherein the same reference numerals offset by a factor of 200 are used to identify similar features as discussed above. The secondary coil portion 210 has a magnetic core 212, a secondary spool 216 with a high-voltage winding 218 thereon, a primary coil 240 with a low-voltage winding 242 thereon. The high-voltage winding 218 is wound to form four individual sectors 220 spaced axially from one another along a longitudinal axis 222 of the assembly. Three of the four sectors 220 are represented as having the same or substantially the same length, trapezoidal shape and diameter, with an end sector 238 having a reduced diameter.

Accordingly, it should be recognized that a secondary coil portion constructed in accordance with the invention can have various configurations, wherein the individual sectors can have differing lengths to maximize the amount of induction over a given region, shapes and diameters, and that the number of separate sectors can be varied from one secondary coil portion to another, as desired for the intended internal combustion engine application. Accordingly, the amount of parasitic capacitance can be limited, and the amount of desired inductance can be maximized.

Obviously, many modifications and variations of the present invention are possible in light of the above teachings. It is, therefore, to be understood that within the scope of the appended claims, the invention may be practiced otherwise than as specifically described.

What is claimed is:

1. An ignition coil configured for electrical communication with a spark plug of an internal combustion engine, comprising:

a primary spool having a bore and an outer surface;

a low-voltage winding supported on said outer surface of said primary spool;

a secondary spool having a cavity and an uninterrupted cylindrical outer surface extending along a longitudinal axis between opposite ends, said secondary spool being received at least partially in said bore of said primary spool;

a magnetic core received in said cavity of said secondary spool; and a high-voltage winding supported on said cylindrical outer surface of said secondary spool, said high-voltage winding having discrete sectors spaced from one another along said longitudinal axis, said sectors being shaped having at least one of a triangular or trapezoidal shape in axial cross-section.

2. The ignition coil of claim 1 wherein at least some of the discrete sectors are trapezoidal in shape.

3. The ignition coil of claim 1 wherein at least one of said discrete sectors is different from others of the discrete sectors in at least one of axial length and diameter.

4. The ignition coil of claim 3 wherein said at least one of said discrete sectors is different in axial length from the other of the discrete sectors.

5. The ignition coil of claim 4 wherein said discrete sectors are configured having end sectors adjacent opposite ends of said secondary spool and a central sector located between said end sectors, said central sector having a greater axial length than said end sectors.

6. The ignition coil of claim 5 wherein said central sector has the greatest axial length of said sectors.

7. The ignition coil of claim 5 further including intermediate sectors positioned between said central sector and said end sectors.

8. The ignition coil of claim 7 wherein said intermediate sectors have an axial length greater than said end sectors and less than said central sector.

9. The ignition coil of claim 8 wherein said intermediate sectors and said central sector are trapezoidal in shape.

10. The ignition coil of claim 3 wherein said at least one of said discrete sectors is different in height from the other of the discrete sectors.

11. The ignition coil of claim 10 where each of said sectors has a different height.

12. The ignition coil of claim 11 wherein said sectors increase in height progressively from one end of said secondary spool to an opposite end of said secondary spool.

13. The ignition coil of claim 1 wherein at least one of said sectors is triangular in axial cross-section.

14. The ignition coil of claim 13 wherein at least one of said sectors is trapezoidal in axial cross-section.

15. The ignition coil of claim 14 wherein at least one of said triangular sectors and at least one of said trapezoidal sectors have the same height.

* * * * *